United States Patent [19]

Asija

[11] 4,021,950

[45] May 10, 1977

[54] MAGIC WINDOW

[76] Inventor: Satya Pal Asija, 1674 Marion St., Saint Paul, Minn. 55117

[22] Filed: Mar. 8, 1976

[21] Appl. No.: 665,104

[52] U.S. Cl. ..... 40/158 R; 40/67; 272/8 N

[51] Int. Cl.[2] ..... G09F 1/00

[58] Field of Search ..... 272/8 R, 8 D, 8 N, 21, 272/25, 27 B, 9; 273/155; 46/1 L, 21, 30, 31; 206/431; 40/155, 124.1, 126 A, 158 R, 159, 28 R, 67

[56] References Cited

UNITED STATES PATENTS

| | | | |
|---|---|---|---|
| 786,469 | 4/1905 | Stirn | 40/158 R |
| 1,772,338 | 8/1930 | Cherry | 40/158 R |
| 2,007,421 | 7/1935 | Coughlin | 46/1 L |

OTHER PUBLICATIONS

Pp. 34 and 35 of the Amateur Entertainer, 1926.

*Primary Examiner*—Richard C. Pinkham
*Assistant Examiner*—Arnold W. Kramer

[57] ABSTRACT

A game & magic device in the art of origami comprising two identical & symmetrical laminations or pieces of paper or the like with aperture in the middle, joined at the periphery of the aperture. The papers have generally identical and symmetrical plurality of equidistant folds or creases and exhibit areas on the outside surfaces. Transparent pockets are provided for easy replacement of exhibits. The objective of the device is to reflect in the center aperture any one of the illustrations or exhibits. The device can be used as an advertising aid especially with political campaign and american bicentennial themes.

3 Claims, 11 Drawing Figures

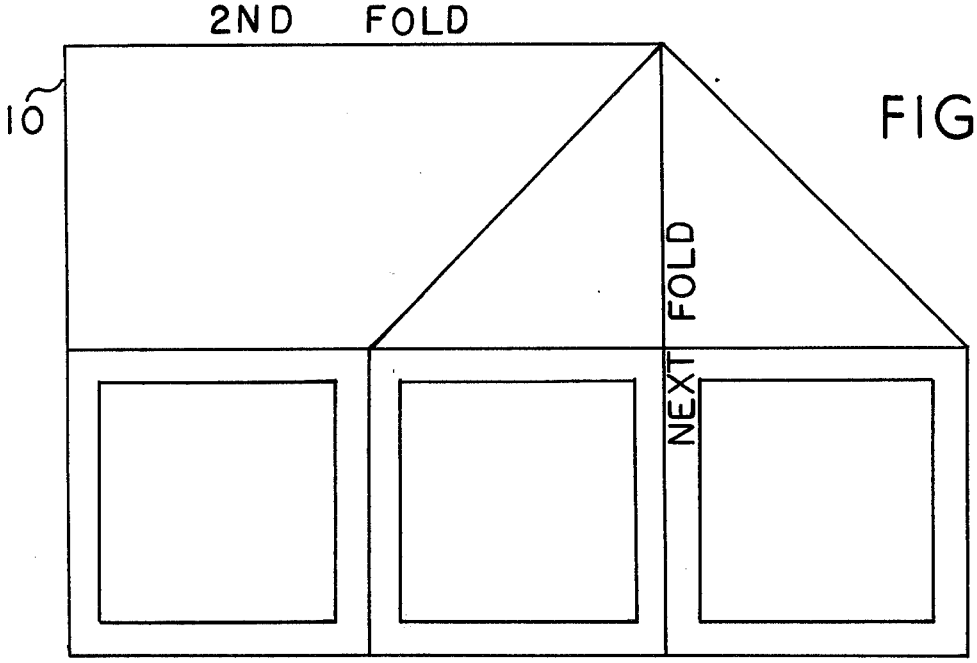
FIG.7
FIG.8
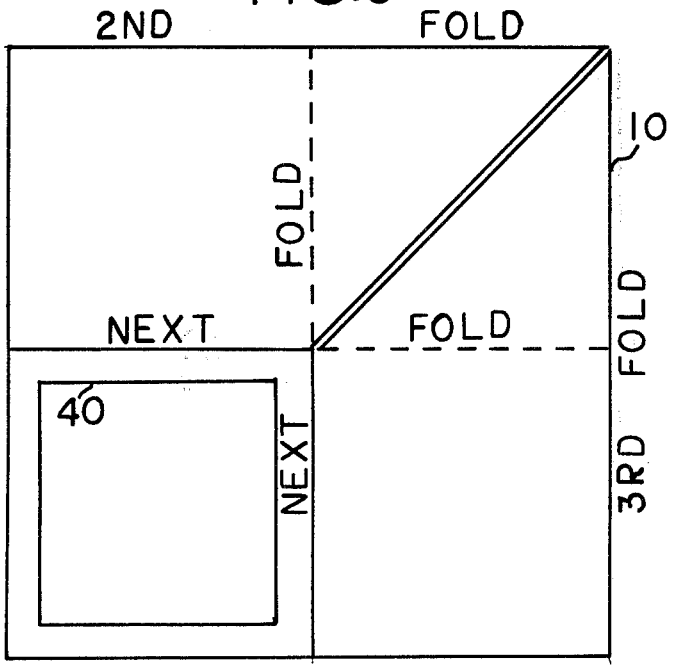

MAGIC WINDOW

BACKGROUND OF THE INVENTION

In political campaigns, it is frequently desirable to present the credentials of the candidates to their constituents in such a creative manner that they catch the attention of even the most casual and indifferent voter. It is the object of this invention to present the resume of a candidate in a fun and game magic device.

Another object of this invention is to promote the american bicentennial themes to children in simple, interesting and memorable ways.

Another object of this invention is to perform simple magic tricks.

Another object of this invention is to serve as an educational toy even for the poor children.

Other objects and advantages may reside in the construction of the device as may be apparent from the following description.

SUMMARY

The object of the device of this invention is to reflect in the aperture one of the many illustrations reproduced on its surfaces as an apparent magic trick. The device comprises two symmetrical and equal laminations of paper or of other flexible but durable material, with equal size aperture in the middle, joined to each other at the periphery of the aperture. The surfaces of the papers or laminations have generally symmetrical and identical plurality of exhibit areas on the outside surfaces each with different exhibit or illustration on the exhibit area. Pairs of exhibits are utilized such that the two outside surfaces are identical in all respects. The exhibit areas are approximately equal to the size of the aperture but not necessarily of the same shape as the aperture. Transparent pockets may be provided to facilitate easy replacement of exhibits. A transparent lamination or sheet of paper may be sandwiched between the two papers over the aperture to provide extra life, strength and beauty to the device. The orientation of the illustrations is generally towards the aperture but may be varied to suit individual taste by pasting, stapling or otherwise attaching different exhibits in the exhibit areas. Generally the exhibits are identical on each lamination for best illusion, however they may be varied to create different affect.

Each page has plurality of symmetrical and identical, and equidistant creases or folds so as to facilitate folding of each paper over the aperture in the opposite direction, such that the exhibit area that is folded first over the aperture is visible in the aperture when unfolded from the other side. An embodiment comprises two identical square pieces of paper with two verticle and two horizontal equidistant folds, thereby creating up to eight exhibit areas at the periphery of the aperture. To perform the magic trick user merely unfolds one sheet of the two identical pieces of paper and asks the audience to select an exhibit for reflection in the center. User then folds the paper with selected exhibit folded first over the aperture by selecting the adjacent appropriate crease already made for the purpose and folding the paper along that crease. The user then folds the remaining folds in any order as long as they match the shape of the folds of the other paper. To create the illusion of magic, user would then generally chant a few magic words and even ask his audience to blow on it so as to give the user time to reverse sides, so that top becomes bottom and the bottom become stop, without being noticed by the audience. The user then begins to unfold from the other side, which is now at the top. The desired exhibit naturally appears in the aperture because that was folded first on the other sheet, often to the utter amazement of the audience. The process can then be repeated plurality of times since both surfaces are equal, symmetrical and identical in appearance in all respects.

BRIEF DESCRIPTION OF THE DRAWINGS

FIGS. 6, 7 & 8 show the device after one, two and three folds respectively, when a corner exhibit is desired in the centre by the audience.

DESCRIPTION OF THE PREFERRED EMBODIMENT

Figure 1:
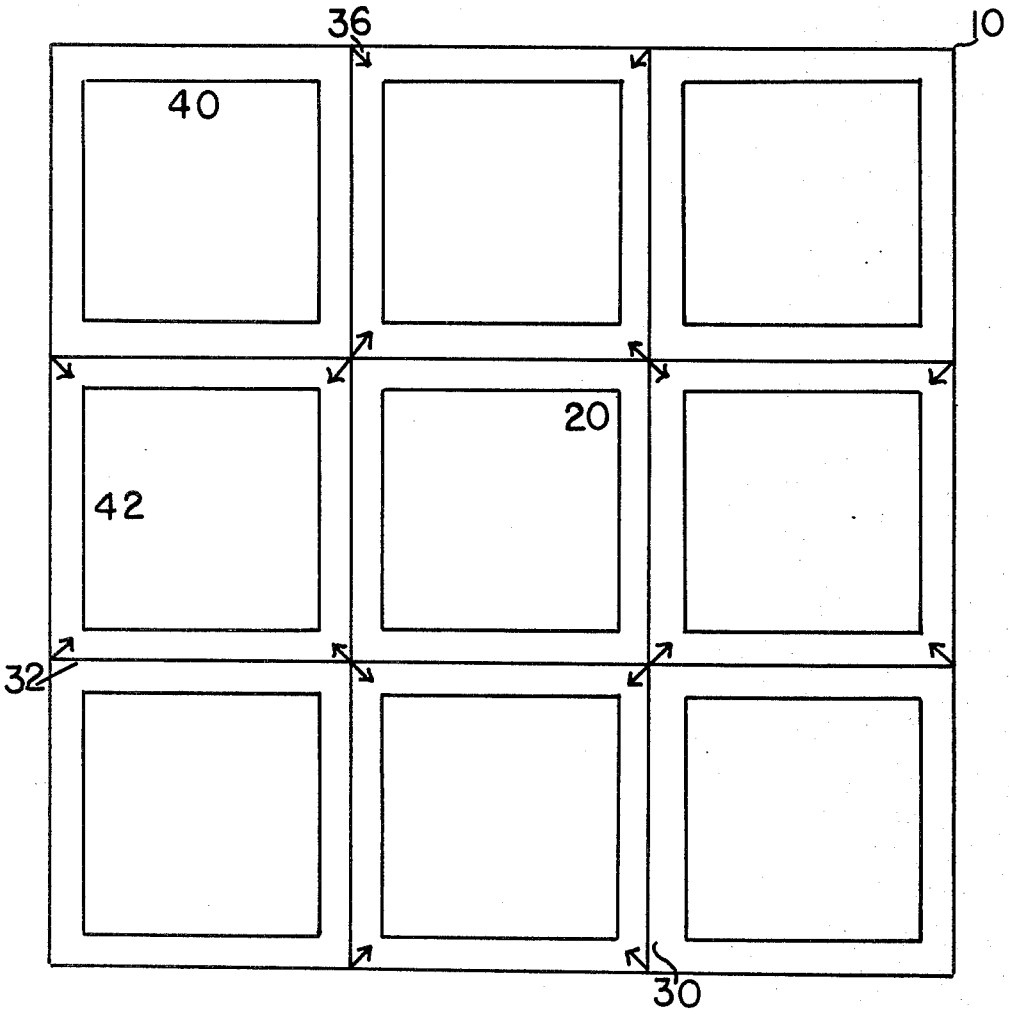
FIG. 1 is a diagram of the top or plan view of one of the two identical square pieces of paper, with aperture in the center.
Figure 2:
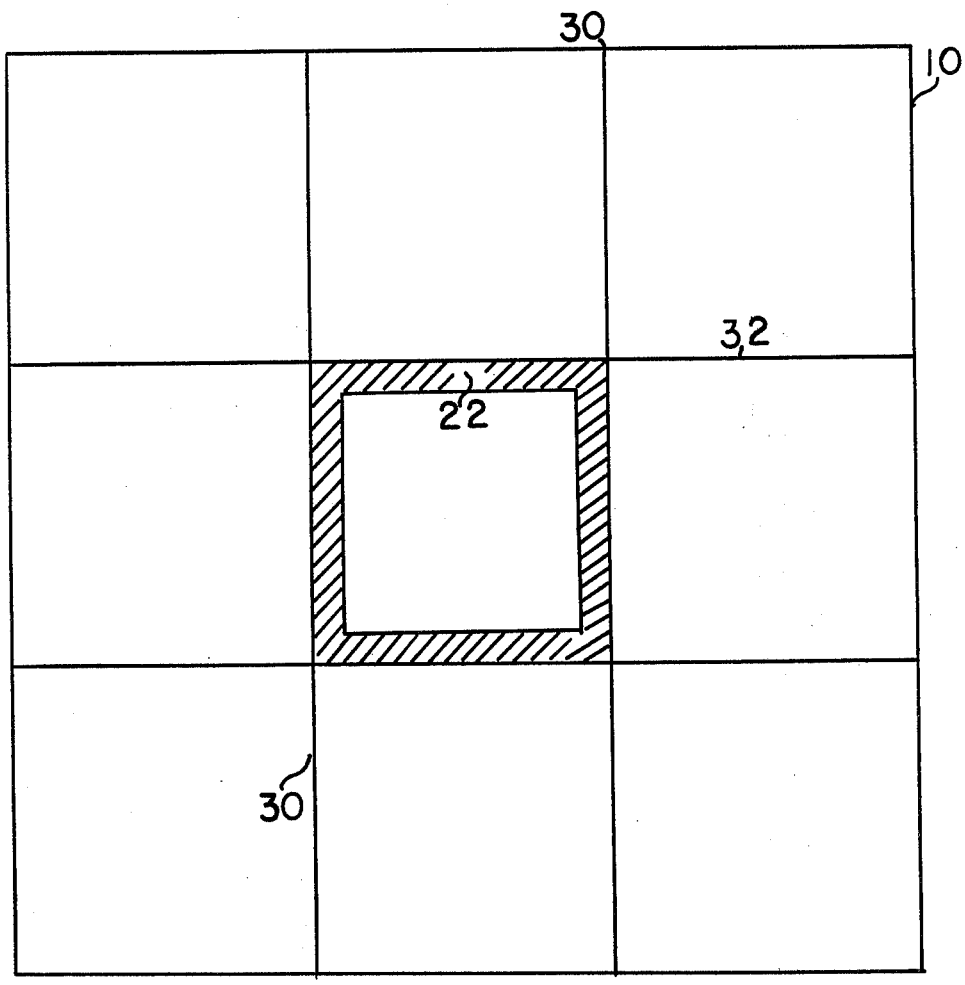
FIG. 2 is a bottom view of the two identical square pieces of paper, showing the area for joining the two pieces of paper back to back.
Figure 3:
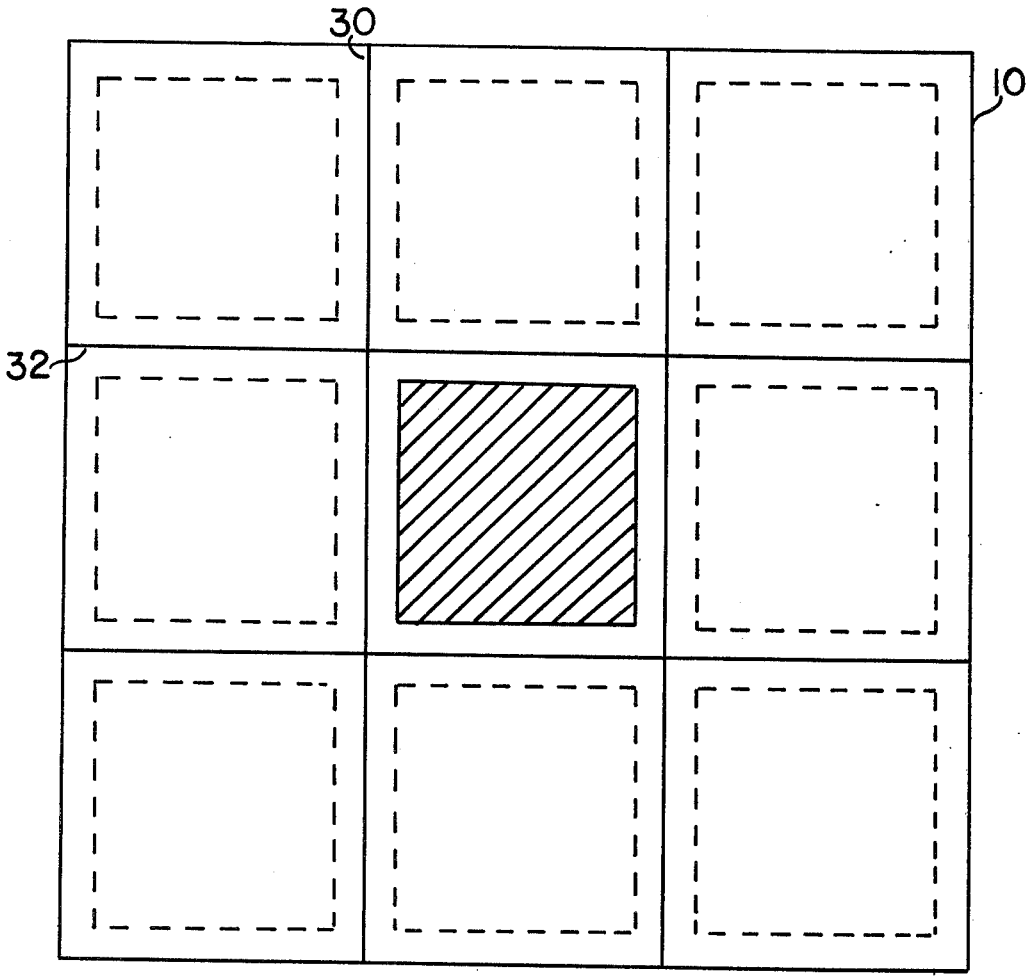
FIG. 3 is a top or plan view of the device with top sheet completely folded and the bottom side completely unfolded.

As shown in FIG. 1 a version of the origami device comprises two identical symmetrical square pieces of paper 10 each having an aperture 20 and two equidistant vertical creases 30 and two equidistant horizontal creases 32 and plurality of exhibit areas 40 and 42. The preferred embodiment shows eight exhibit areas but only four creases such that four corner exhibit areas 40 are for informational purposes. Remaining four exhibit areas 42 are reflectable in the center. The corner exhibit areas can be made reflectable in the center by adding addditional diagonal folds along the arrows 36.

Figure 5:
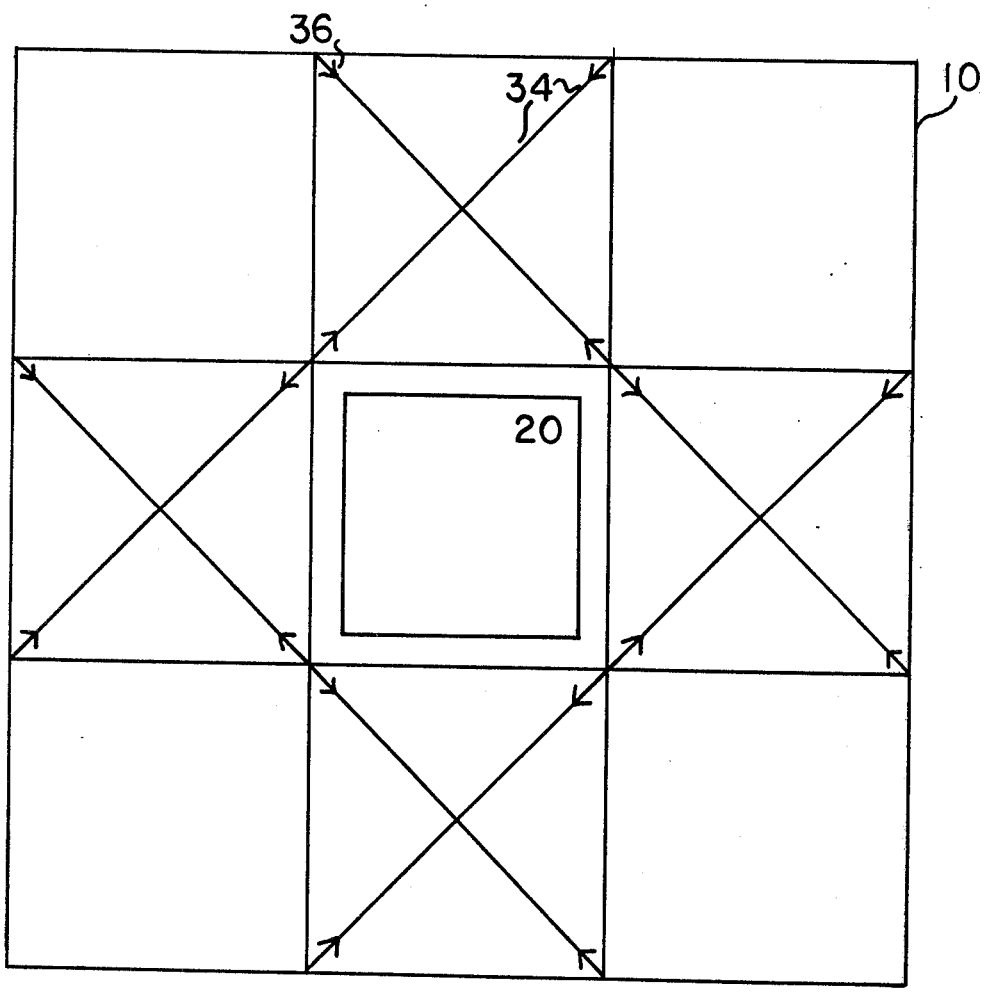
FIG. 5 shows creases for the eight exhibit area embodiment, comprising two verticle folds, two horizontal folds and four diagonal folds along the arrows.
Figure 9:
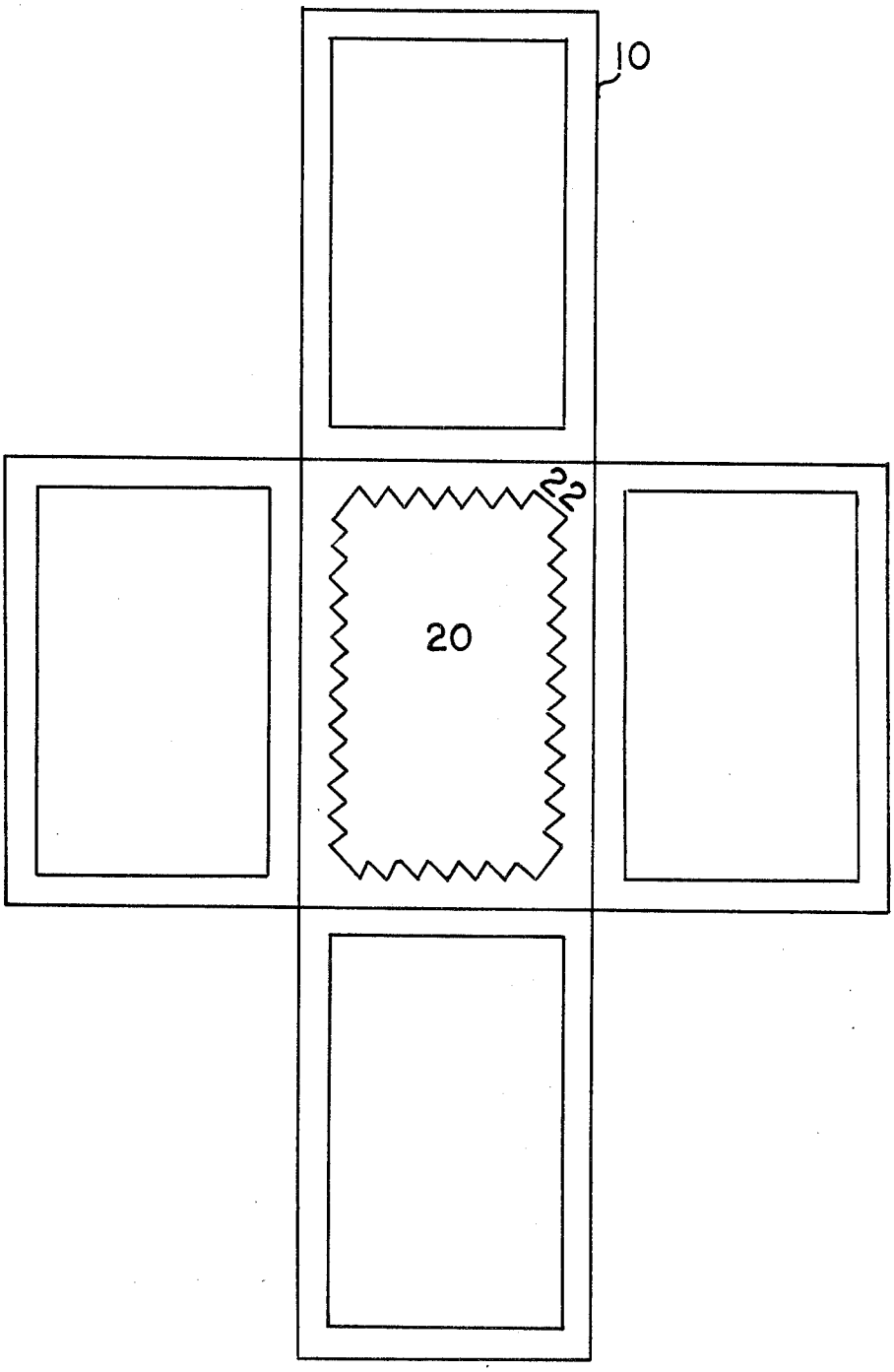
FIG. 9 shows the device where no corner exhibit areas are included and where exhibit areas are rectangular.
Figure 10:
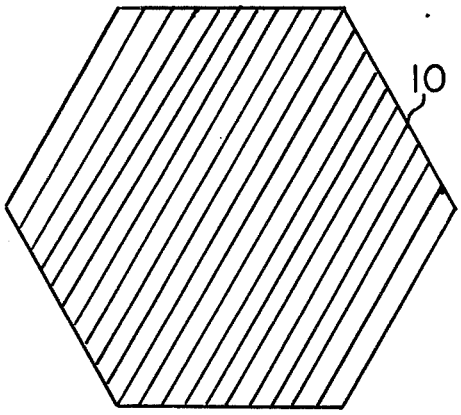
FIG. 10 shows another embodiment of the device fully folded with all six hexagon shaped exhibit areas folded over the aperture.

The device is constructed by joining two pieces of paper 10back to back at the periphery 22 by applying suitable cement, or stapling or the like. The aperture is made smaller than the area enclosed by vertical and horizontal creases 30 and 32. It is this differential area 22 that is used for joining the two pieces 10 back to back. Generally exhibits on the two sheets are identical but no two exhibits are same on the same sheet. Vertical and horizontal creases are made equidistant by putting them at a distance of one third the side of the square from each other or from the sides of the sheet of paper or other lamination. Sometimes a transparent sheet of paper (not shown), somewhat larger than the aperture 20 but not exceeding the area enclosed by two vertical 30 and two horizontal folds 32 is sandwiched between two square pieces of paper 10 over the aperture 20 to add extra life, strength and esthetics to the device. In order to make the corner exhibit areas reflectable in the center aperture 20, diagonal creases 34 are added along the arrows 36 as shown in FIG. 5. Alternatively the corner exhibit areas 40 may be removed altogether thereby changing the shape of square paper to cross paper as shown in FIG. 9.

The preferred embodiment suggests the device be made of paper. In actual practice any durable and flexible material may be employed. The shape may also be varied from square to rectangular, circular, cross or hexagon or the like to suit individual taste. Likewise the preferred embodiment implies identical exhibits, such as pennies, stamps, playing cards, pictures, drawings etc., but in practice the exhibits may be dissimilar on each side. By the same token the preferred embodiment shows square aperture and exhibit areas. In practice they may be of different shapes and sizes so as to create masking effect. The preferred embodiment also suggests certain order of folds, however it may be varied commensurate with the users' skill, appearance and appeal.

Figure 11:
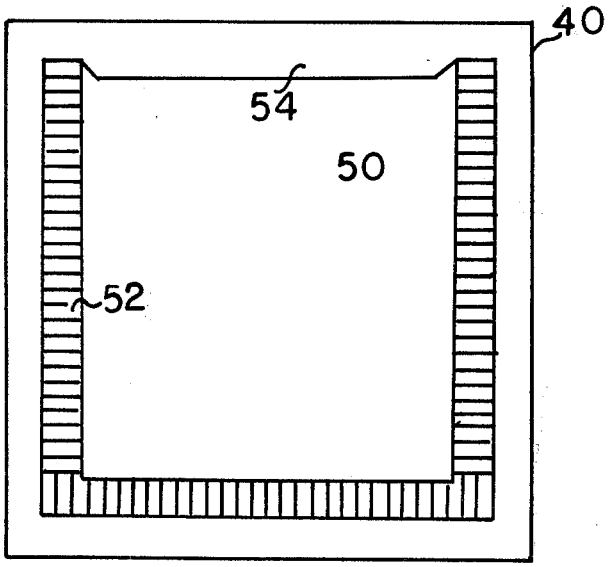
FIG. 11 shows an exhibit pocket so that different exhibits can be easily replaced.

The exhibit areas may be bounded by different shapes to facilitate easy recognition by little children. The exhibit areas may be transformed into transparent pockets by using a transparent sheet of paper sealed on three sides and open on one side. This is desireable to facilitate easy replacement of the exhibits. FIG. 11 shows such a transparent pocket 50 placed over an exhibit area 40, having three sides sealed 52 and one side open 54. Accordingly illustrations on the exhibit areas may be pasted, stapled or inserted in transparent pockets provided for the purpose.

Another embodiment of the device may be made by using two sets of plurality of transparent and symmetrical envelopes, each set joined to form a common aperture in the centre of approximately same shape and size as said transparent envelope.

Other variations can be made without deviating from the spirit of the invention of this device.

OPERATION

Figure 4:
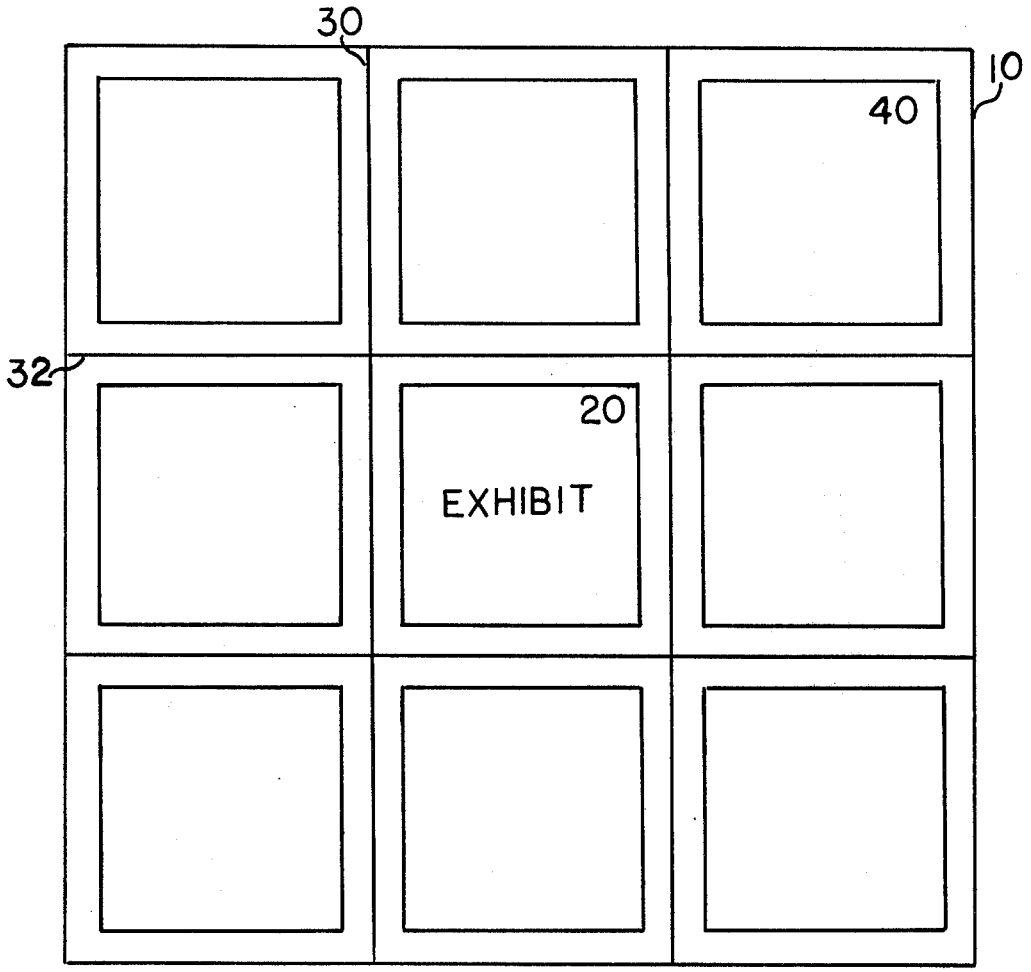
FIG. 4 is a bottom view of the FIG. 3 with bottom side folded and the top side unfolded.

Before performing the magic trick, assume that the device is fully folded. A user would then unfold one side completely as shown in FIG. 4. There are 8 different illustrations visible. One of the 8 illustrations also appears in the center through the aperture, thereby making a total of 9 exhibits.

The user then asks the audience to select an exhibit for reflection in the center, assume that the audience ask for one of the center exhibits 42 as contrasted to corner exhibit 40 for reflection to the center. The user then merely folds along the corresponding vertical or horizontal line such that the exhibit selected by the audience is overlapped face down over the aperture. Remaining folds may be made in any order, consistent with the shape of the folds of the other sheet of paper.

The user then asks his audience to blow on it or chant some magic words, so as to have enough time to reverse the top and bottom of the device. The user then nonchalantly starts unfolding from the other side, which is now at the top. The audience is generally amazed to find the desired exhibit transferred in the center, not realizing that this is a different surface since both sides are identical in all respects.

Figure 6:
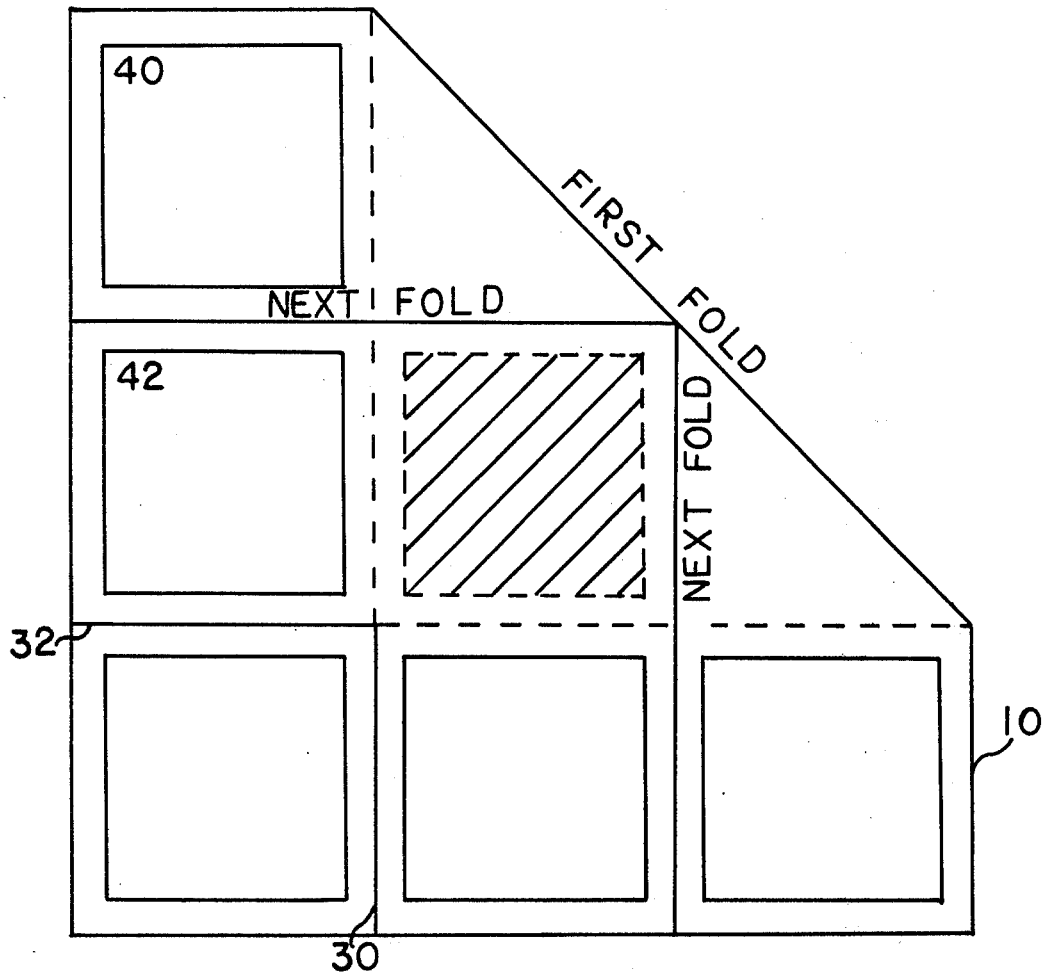

If the audience point to corner exhibit area for reflection in the center, then the folding sequence shown in FIGS. 6, 7 and 8 respectively should be followed, so as to ensure that the folded shapes of both sheets are identical. In such a case the first fold is at the diagonal crease, which completely separates that exhibit from the rest. The next two folds should be two adjacent vertical and horizontal folds in any order. The remaining folds can then be made in any order.

The process can be repeated any number of times, without any pause for readjustment, since both sides are identical in all respects.

A minor variation of the above magic trick is accomplished by using substantially similar exhibits on the same side of the sheet, for example pennies with different years. An identical set of pennies is also placed on the exhibit areas of the other side. In this version the user purports to create the illusion of the ability to change the year of the penny in the center. Likewise the magic trick by using appropriate playing cards, can be modified to create the illusion of changing the center card from 10 of clubs to 10 of hearts.

The applicant claims:

1. An origami magic device comprising:

a. a first square piece of paper having two parallel vertical and two parallel horizontal equidistant creases;

b. an aperture in said first square piece of paper of a size somewhat smaller than the area enclosed by said two vertical and said two horizontal creases;

c. a plurality of exhibit areas of approximatelysame size as said aperture around the circumference of said aperture;

d. a second square piece of paper identical to said first square piece of paper in all respects, including said aperture, said creases and said exhibit areas, wherein said second square piece of paper is joinedback to back to said first square piece of paper around the periphery of said aperture within the boundary formed by said two vertical and said two horizontal equidistant creases;

e. eight different exhibits, placed one each, in the eight squares made by said vertical and horizontal creases on said first square piece of paper, and exact duplicates of said eight different exhibits on said second square piece of paper in the like manner; and f. two pairs of equidistant diagonally parallel creases made at approximately 45° angle to said vertical and horizontal creases on said first and second pieces of paper.

2. An origami magic device of claim 1, wherein a transparent sheet of paper of a size approximately equal to the area bounded by said vertical and horizontal creases is sandwiched between said first and second square pieces of paper over said aperture.

3. An origami educational device comprising;

a. a first square piece of paper having two parallel vertical and two parallel horizontal equidistant creases;

b. an aperture in said first square piece of paper of a size somewhat smaller than the area enclosed by said two vertical and horizontal creases;

c. a plurality of exhibit areas of approximately same size as said aperture around the circumference of said aperture;

d. a plurality of transparent pockets formed by affixing transparent pieces of lamination over said exhibit areas;

e. a second square piece of paper identical to said first square piece of paper in all respects, including said aperture, said creases, said exhibit areas and said transparent pockets, wherein said second square piece of paper is joined back to back to said first square piece of paper around the perphery of said aperture within the boundary formed by said two vertical and said two horizontal equidistant creases;

f. eight different exhibits, placed one each, in the eight squares made by said vertical and horizontal creases on said first square piece of paper and exact duplicates of said eight different exhibits on said second square piece of paper in the like manner; and g. two pairs of equidistant diagonally parallel creases made at aproximately 45° degree angle to said vertical and horizontal creases on said first and second square pieces of paper.

* * * * *